US010883508B2

(12) United States Patent
Dokhale et al.

(10) Patent No.: US 10,883,508 B2
(45) Date of Patent: Jan. 5, 2021

(54) EDDY PUMP

(71) Applicant: Eddy Pump Corporation, El Cajon, CA (US)

(72) Inventors: Mugdha Shrikant Dokhale, San Diego, CA (US); Dan Wahlgren, Escondido, CA (US)

(73) Assignee: EDDY PUMP CORPORATION, El Cajon, CA (US)

( * ) Notice: Subject to any disclaimer, the term of this patent is extended or adjusted under 35 U.S.C. 154(b) by 120 days.

(21) Appl. No.: 16/176,495

(22) Filed: Oct. 31, 2018

(65) Prior Publication Data

US 2020/0132076 A1 Apr. 30, 2020

(51) Int. Cl.
*F04D 17/10* (2006.01)
*F04D 29/42* (2006.01)

(52) U.S. Cl.
CPC ..... *F04D 17/10* (2013.01); *F04D 29/4206* (2013.01)

(58) Field of Classification Search
CPC ..... F04D 17/10; F04D 29/4206; F04D 29/329
See application file for complete search history.

(56) References Cited

U.S. PATENT DOCUMENTS 2,247,813 A 7/1941 Huitson
2,704,516 A * 3/1955 Mock et al. ..... F02M 37/06 415/56.5
2,710,580 A 6/1955 Holzwarth
3,065,954 A 11/1962 Whitake
3,167,021 A * 1/1965 Sence ..... F04D 29/628 415/131
3,171,357 A * 3/1965 Egger ..... F04D 13/0646 415/206
3,759,628 A * 9/1973 Kempf ..... F04D 7/04 415/225
4,592,700 A * 6/1986 Toguchi ..... F04D 29/2244 415/225
4,594,052 A 6/1986 Niskanen
4,596,511 A 6/1986 Weinrib
4,676,718 A * 6/1987 Sarvanne ..... F04D 29/2244 415/225
4,776,753 A 10/1988 Weinrib
4,792,275 A * 12/1988 Weinrib ..... F04D 7/04 415/120

(Continued)

FOREIGN PATENT DOCUMENTS

WO 2008/034049 A1 3/2008

OTHER PUBLICATIONS

International Search Report and Written Opinion dated Dec. 31, 2019 in corresponding International Application No. PCT/US2019/057162, filed Oct. 21, 2019.

*Primary Examiner* — Nathaniel E Wiehe
*Assistant Examiner* — Eric A Lange
(74) *Attorney, Agent, or Firm* — Global IP Counselors, LLP

(57) ABSTRACT

A pump rotor includes a hub, a back plate and a plurality of blades extending from the hub and disposed on the back plate. Each of the plurality of blades has an outer surface essentially parallel to a rotational axis of the hub, and a first end adjacent the hub and a second end distal from the hub, the first end having a height from the planar surface that is less than a height from the planar surface of the second end. The plurality of blades is configured to cause a synchronized central column of flow.

21 Claims, 6 Drawing Sheets

(56) References Cited

U.S. PATENT DOCUMENTS

| | | | | |
|---|---|---|---|---|
| 4,815,929 | A | 3/1989 | Weinrib | |
| 4,904,159 | A | 2/1990 | Wickoren | |
| 4,914,841 | A | 4/1990 | Weinrib | |
| 4,981,413 | A | 1/1991 | Elonen et al. | |
| 5,242,268 | A | 9/1993 | Fukazawa et al. | |
| 6,139,274 | A | 10/2000 | Heer | |
| 6,158,959 | A | 12/2000 | Arbeus | |
| 6,398,498 | B1 | 6/2002 | Boyesen | |
| 7,318,703 | B2 | 1/2008 | Schober | |
| D806,754 | S | 1/2018 | Rhyner et al. | |
| 2012/0121421 | A1 | 5/2012 | Wait | |
| 2017/0102005 | A1 | 4/2017 | Schuldt | |
| 2018/0142691 | A1* | 5/2018 | Rhyner | F04D 7/04 |

* cited by examiner

EDDY PUMP

BACKGROUND

Field of the Invention

The present invention generally relates to an eddy pump. More specifically, the present invention relates to eddy pump including a rotor that improves pumping performance using a synchronized eddy.

Background Information

Conventional pumps are designed to pump a variety of liquids, materials and slurries (i.e., solids suspended in liquid). One type of conventional pump is a centrifugal pump. In a centrifugal pump fluid or slurry enters axially through a casing, is caught up in the impeller blades, and is tangentially and radially spun outward through a diffuser part of the casing. When pumping slurries, it is important to minimize direct contact of solid material to the impeller, due to wear on the impeller.

SUMMARY

It has been discovered that pump characteristics are improved and wear is minimized by a new pump design that forms a synchronized central column of flow from the pump rotor to the pump inlet and creates a low-pressure reverse eddy flow from the pump inlet to the pump discharge. The new pump design also results in an area of negative pressure near the pump seal. The negative pressure allows the pump to achieve zero (or near zero) leakage.

In view of the state of the known technology, one aspect of the present disclosure is to provide a pump rotor comprising a hub, a back plate and a plurality of blades extending from the hub and disposed on the back plate. The back plate has a planar surface. Each of the plurality of blades has an outer surface essentially parallel to a rotational axis of the hub, a first end adjacent the hub and a second end distal from the hub. The first end has a height from the planar surface that is less than a height from the planar surface of the second end. The plurality of blades is configured to cause a synchronized central column of flow.

Another aspect of the present invention is to provide a pump, comprising a housing and a rotor. The housing has an intake and a discharge. The rotor includes a hub, a back plate, and a plurality of blades extending from the hub and disposed on the back plate. Each of the plurality of blades has an outer surface essentially parallel to a rotational axis of the hub, and a first end adjacent the hub and a second end distal from the hub. The first end has a height from the planar surface that is less than a height from the planar surface of the second end. The plurality of blades is configured to cause a synchronized central column of flow.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
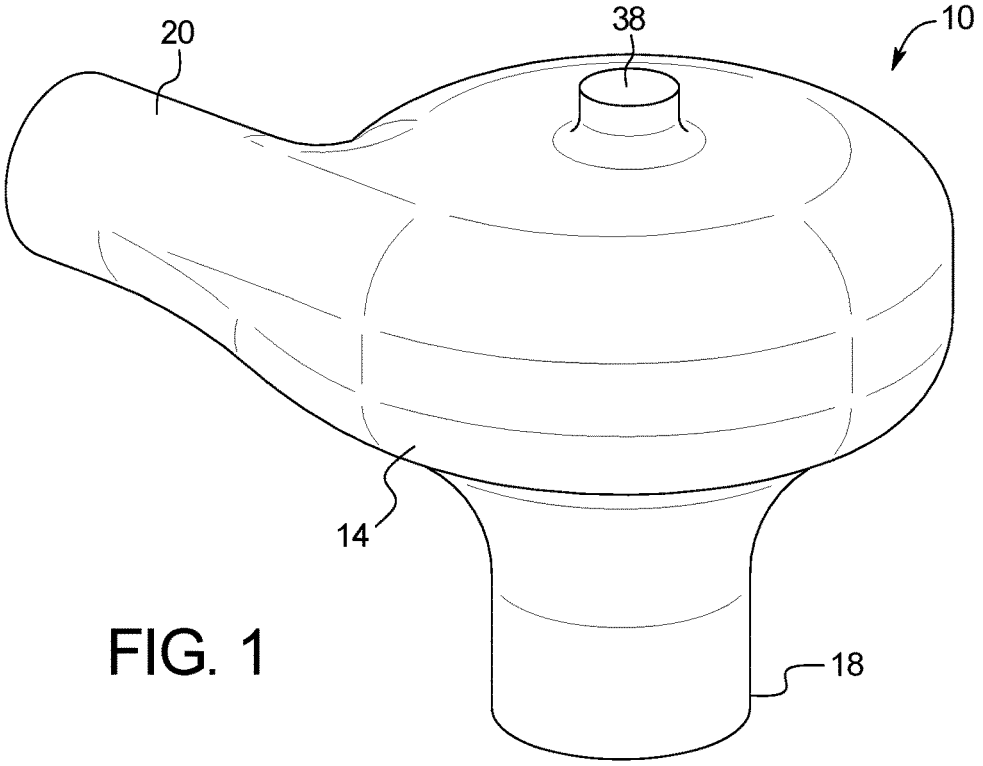
FIG. 1 is a top perspective view of a pump according to one embodiment of the present invention.
Figure 2:
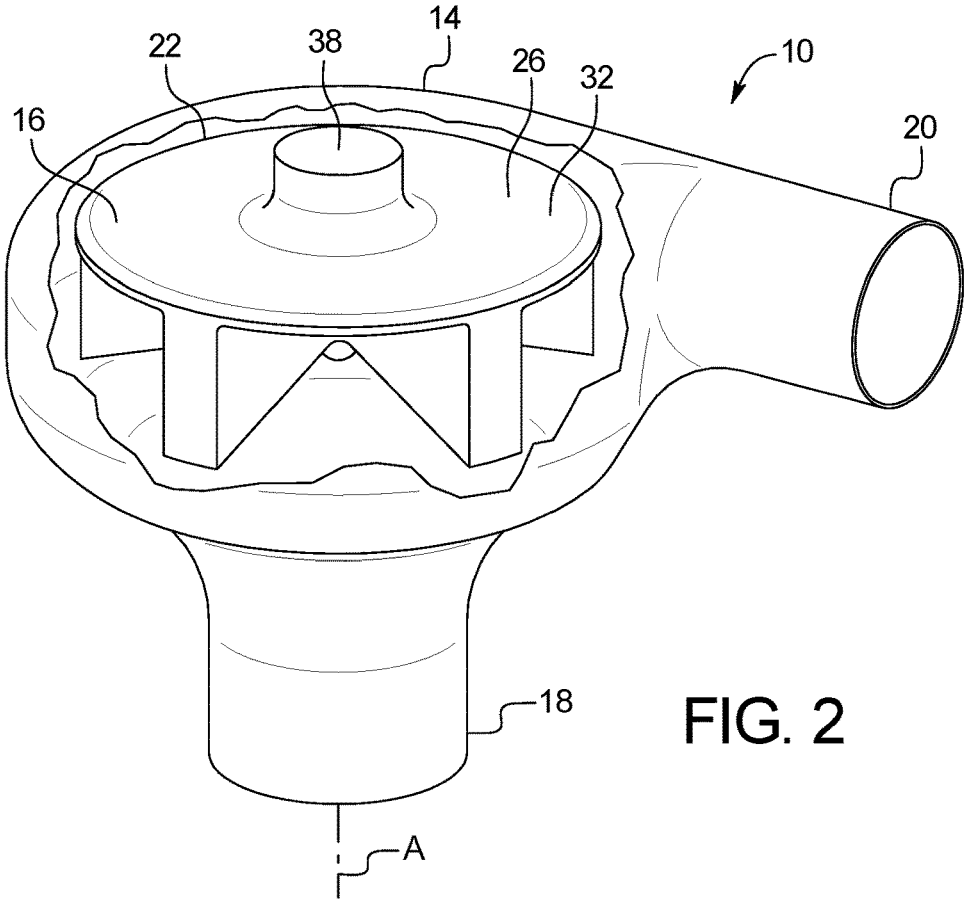
FIG. 2 is a top perspective view in section of the pump of FIG. 1.
Figure 3:
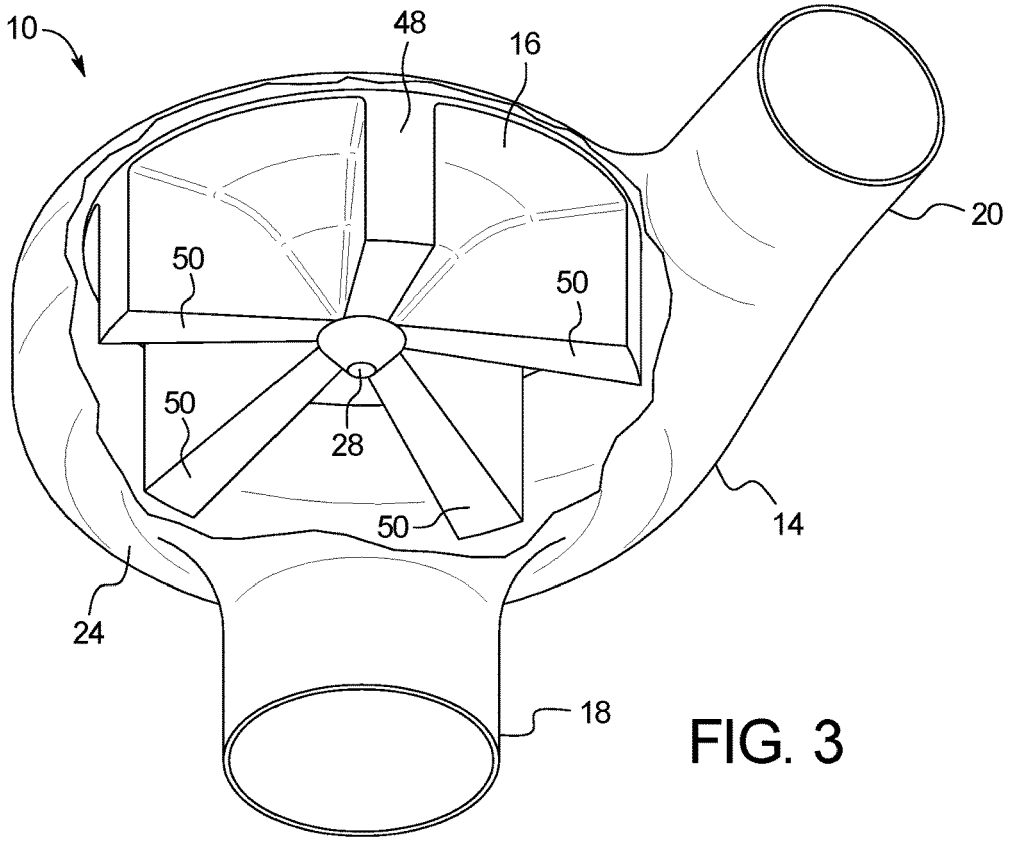
FIG. 3 is a bottom perspective view in section of the pump of FIG. 1.
Figure 12:
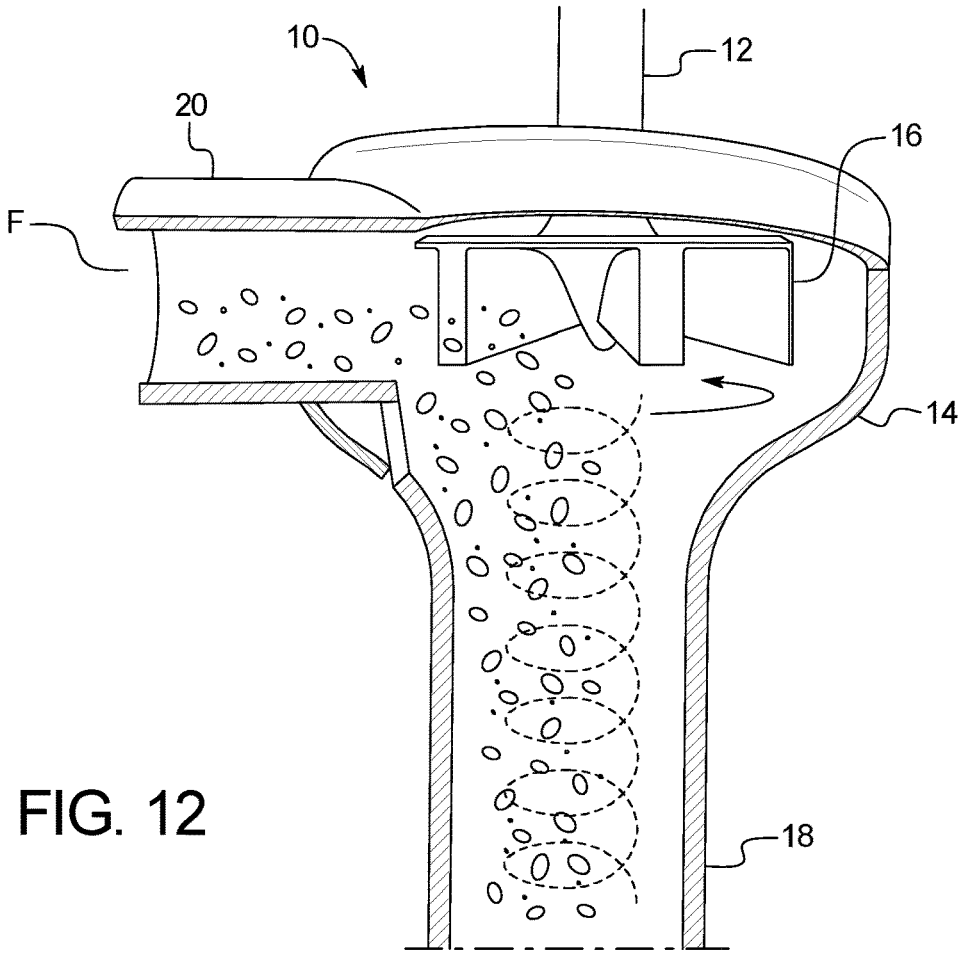
FIG. 12 is a cross-section view of the pump of FIG. 1 illustrating the flow of slurry through the pump.

Referring initially to FIGS. 1, 2 and 12, a pump 10 is illustrated in accordance with a first embodiment. The pump 10 includes a drive motor 12, a volute or housing 14 and a rotor 16. The rotor 16 is disposed within the housing 14 such that fluid, liquids, materials and slurries can enter the housing 14 and by pumped by the rotor 16. The rotor 16 is connected to the drive motor 12 (FIG. 12) that is configured to drive or rotate the rotor 16 to pump fluid, liquids, materials and slurries F from the inlet 18 to the discharge. The motor 12 can be any suitable motor known in the art that would be capable of driving the rotor 16 at suitable rotational velocities.

As shown in FIGS. 1-5, the housing 14 is curved and includes an inlet 18 and a discharge or outlet 20. The inner surface 22 of the housing 14 is generally cylindrical and has a diameter $D_1$ that is larger than the diameter $D_2$ of the rotor 16. The inlet 18 is disposed along a rotational or longitudinal axis A of the rotor 16 on the bottom 24 of the housing 14, which enables the fluid or materials F to be sucked or drawn into the housing 14 based on the rotation of the rotor 16. The discharge is disposed 90 degrees offset from the inlet 18 (i.e., in a direction tangential to the rotor 16), which enables the fluid or materials F to be pumped out of the housing 14.

As shown in FIGS. 6-11, the rotor 16 includes a back plate 26, a conical center portion (hub) 28 and a plurality of blades **30*a*-30*e*. The rotor 16 can be cast, molded, forged, machined or formed in any suitable manner. Thus, the back plate 26, the conical center portion 38 and the plurality of blades 30*a*-30*e* can be formed as a unitary one-piece member. The rotor 16 can be an alloy, steel, stainless steel, aluminum, zinc, bronze, rubber, plastic or any other suitable material or combination of materials. Moreover, it is noted that the rotor 16 can be any suitable mater or design. Thus, while the rotor 16 is preferable a unitary one-piece member, the rotor 16** can be formed from in multiple steps or by multiple pieces that are assembled in any suitable manner.

Figure 8:
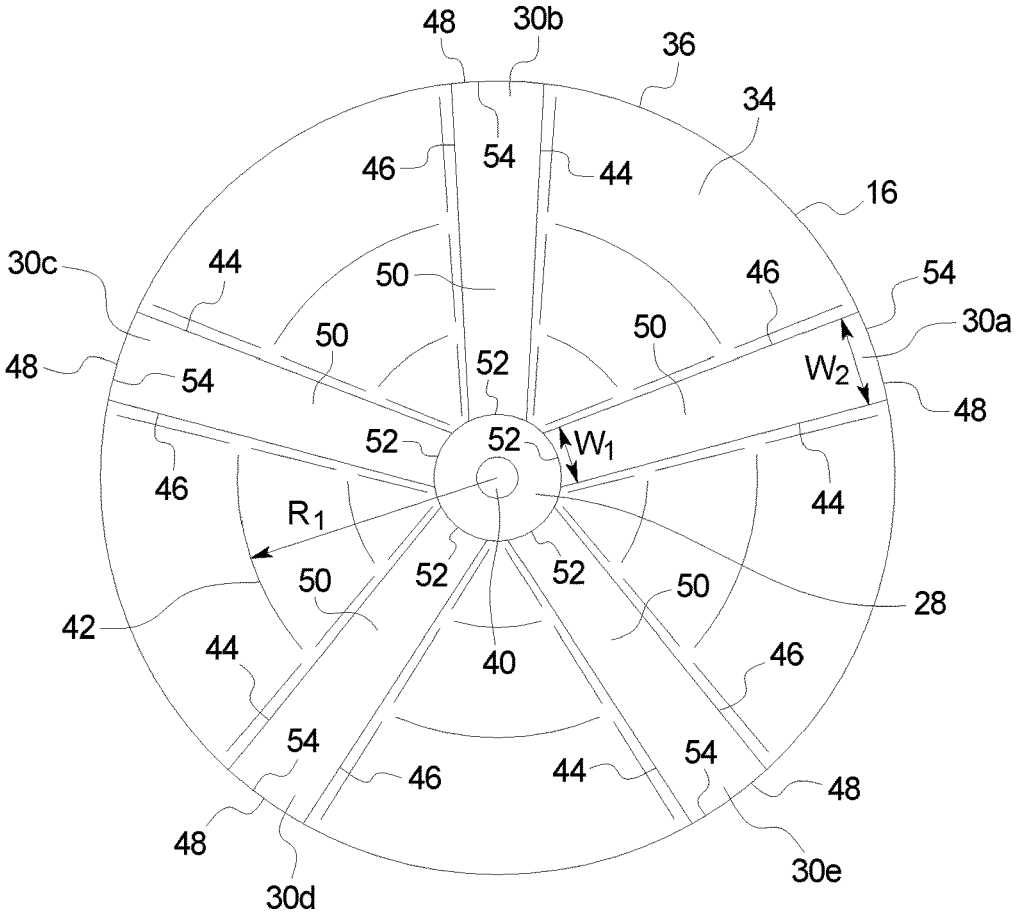
FIG. 8 is a bottom view of the rotor of FIG. 6.
Figure 9:
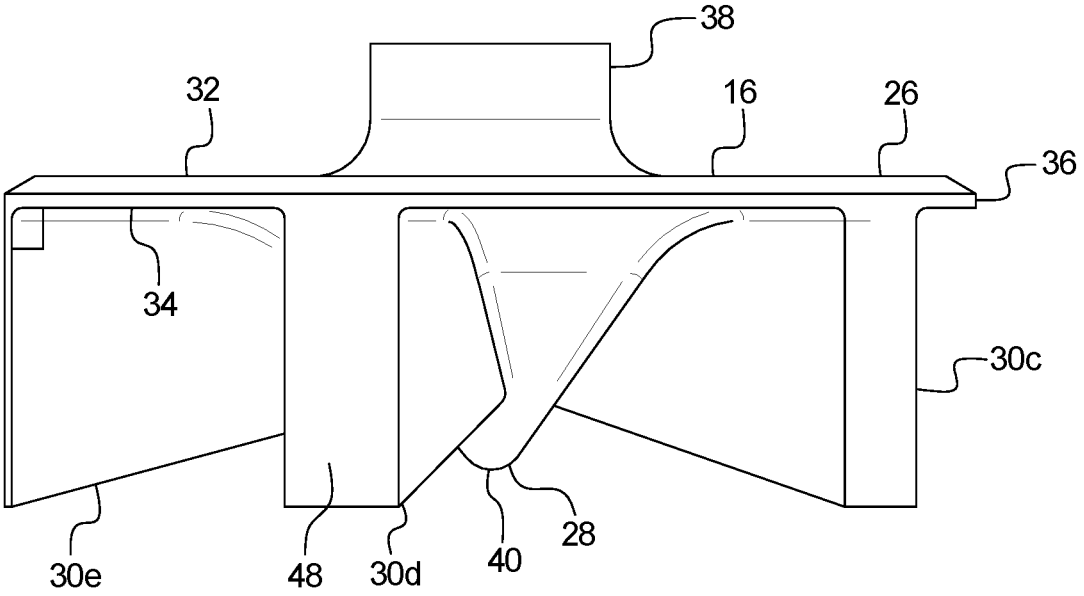
FIG. 9 is a side view of the rotor of FIG. 6.
Figure 10:
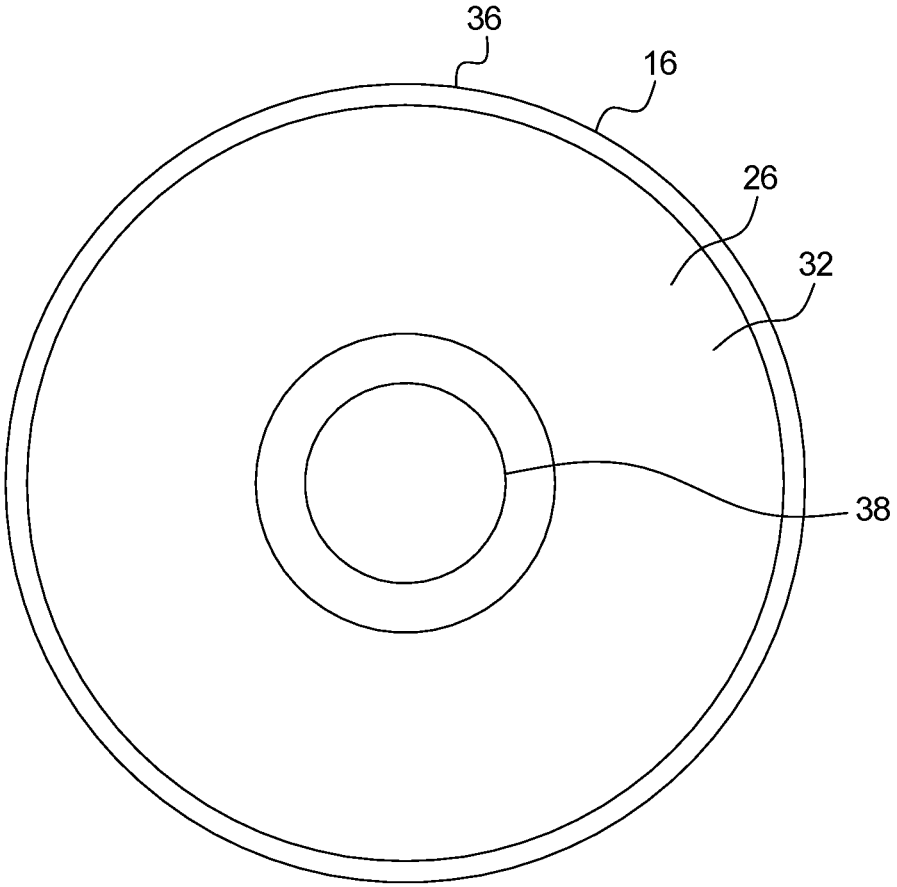
FIG. 10 is a top view of the rotor of FIG. 6.

In one embodiment, the back plate 26 is a generally circular plate having a first side 32 (defining a first planar surface), a second side 34 (defining a second planar surface) and an outer circumferential edge 36. The first or upper side faces 32 the interior surface 22 of the housing 14 and has a protrusion or shaft 38 extending therefrom. The protrusion 38 is connected to or connectable to a drive shaft from the drive motor 12. The second side 34 has the plurality of blades **30*a*-30*e* disposed thereon. As shown in FIG. 8, the back plate 26 extends from the center of the rotor 16 about the same length as the rotor 16, and thus covers the entire rotor blade length. In other words, the plurality of blades 30***a*-30*e* defines a radial diameter, and the back plate 26 has a diameter that is the same as or about the same as the radial diameter of the back plate 26. However, it is noted that the radial diameter of the back plate 26 can be between 0.3 and 1.0 the radial diameter defined by the plurality of blades 30*a*-30*e*, depending on the particle size, or any other parameter. This configuration (i.e., a "full size" back plate 26) prevents fluid from escaping the rotor 16 and facilitates pushing the fluid circumferentially towards the outlet 20 of the rotor 16 and discharge. Moreover, the back plate 26 helps reduce recirculation by maintaining fluid distribution inside the volume of the rotor 16, and prevents leakage and energy losses between the rotor 16 and upper side of the housing 14. The back plate 26 also helps reduce static pressure loss, which contributes to higher pressure differential and head developed by the rotor 16.

Figure 11:
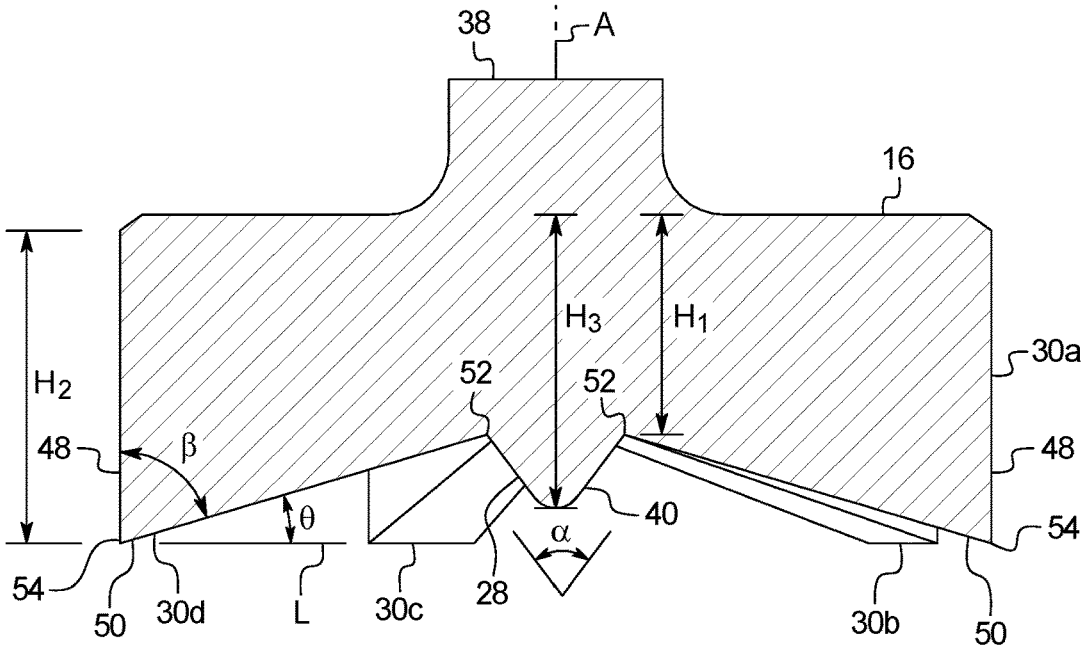
FIG. 11 is a cross-sectional side view taken along lines 11-11 in FIG. 10.

As shown in FIGS. 6-11, the conical center portion 28 is a cone disposed in the center of the rotor 16 and facilitates fixing the rotor 16 to the motor shaft. The conical center portion 28 is disposed on the second side 34 of the back plate 26 and is opposite to the protrusion 38. The conical center portion 28 has a conical vertex 40 and a base 42. The base 42 is adjacent the back plate 26 and tapers toward the conical vertex 40. As shown in FIG. 8, the base 42 has a radius $R_1$ of approximately 10.6 inches and is generally circular. The base 42 radially extends about 50 percent of the base plate. As shown in FIG. 11, the conical vertex of the hub forms an angle $\alpha$ of about 40 degrees. However, the size of the base 42 of the conical center portion 28 and the angle $\alpha$ formed by the conical vertex 40 can be any suitable or desired size or angle.

The conical center portion 28 helps hydraulically by causing suction which enables the fluid to flow inside the housing 14 smoothly from the inlet 18 and facilitates laminar movement towards the outlet 20 or end of the rotor 16 and subsequently to the discharge. This induction of laminar flow aids in reduction of eddy currents and recirculation inside the housing 14, increasing pump efficiency. The size of the conical center portion 28 (length, diameter and angle) can depend on the particle size, allowing better clearances of the particles, as long as laminar flow can be maintained towards the discharge. The conical center portion 28 also helps create better eddy current from the suction to the inlet 18 of the rotor 16 while preventing turbulence at higher flow rates than the best efficiency point allowing a flow rate 140% of the design best efficiency point. The size of the conical center portion 28 can be reduced or increased to control power consumption.

As shown in FIGS. 6-11, the plurality of blades 30*a*-30*e* extends from the conical center portion 28 and is disposed on the first side 34 of the back plate 26. In this embodiment, the plurality of blades 30*a*-30*e* includes five (5) blades, but the plurality of blades 30*a*-30*e* can be any suitable number of blades that form a suitable eddy current. Each of the blades includes a first longitudinal side 44, a second longitudinal side 46, an end or outer surface 48 and a bottom surface 50. Each of the blades 30*a*-30*e* extends radially outwardly from the conical center portion 28 and along a longitudinal direction from the back plate 26. Moreover, since the conical center portion 28 is a cone having a sloping surface from the vertex 40 to the base 42, each of the blades 30*a*-30*e* follows the sloping contour of the conical center portion 28, see FIG. 9 for example.

The first longitudinal side 44 and a second longitudinal side 46 are opposite each other. The first and second longitudinal sides 44, 26 extend in the longitudinal direction, generally parallel to the rotational or longitudinal axis A of the rotor 16 and taper away from each other in the radial direction. That is, as shown in FIG. 8, the first and second longitudinal sides 44 and 46 have a width $W_1$, such that they are disposed about 1.5 inches apart adjacent the conical center portion 28 and have a width $W_2$, such that they are 2 inches apart adjacent the circumferential edge 36 of the back plate 26. Accordingly, as can be understood, the first and second longitudinal sides 44 and 46 separate about 0.5 inches in the radial direction (i.e., in the direction from the rotational or longitudinal axis A to the circumferential edge 36). It is noted that the first and second longitudinal sides 44, 46 can separate in any manner desired or can be parallel, if desired. Moreover, if the size of the rotor 16 is changed, the change in separation of the first and second longitudinal sides 44 and 46 can be changed accordingly. That is, in the embodiment, the change in the separation of the first and second longitudinal sides 44 and 46 is 33 percent. In other words, the separation or width $W_2$ between the first and second longitudinal sides 44 and 46 at the circumferential edge 36 of the back plate 33 percent larger than the separation or width $W_1$ of the first and second longitudinal sides 44 and 46 adjacent the conical center portion 28.

As shown in FIGS. 6, 7, 9 and 11, each of the blades 30*a*-30*e* tapers upwardly from the circumferential edge 36 of the back plate 26 to the conical center portion 28. The bottom surface 50 of each blade 30*a*-30*e* extends from a first end 52 to a second end 54. The first end 52 is adjacent the conical center portion 28 and the second end 54 is adjacent the outer surface 48. The second end 54 preferably is higher than the first end 42 when measured from the second side 34 of the back plate 26. For example, in one embodiment, as shown in FIG. 11, the first end 52 has a height $H_1$ that is approximately 3.17 inches from the back plate 26 and the second end 54 has a height $H_2$ that is 5 inches from the back plate 26. However, it is noted that the first and second ends 52 and 54 can be any suitable distance from the back plate 26. Moreover, if the size of the rotor 16 is changed, the change in heights of the first and second longitudinal ends 52 and 54 can change accordingly. That is, in this embodiment the difference in the heights $H_1$ and $H_2$ of the first and second ends 52 ad 54 is about 58 percent. In other words, the height $H_2$ of the second end 54 is 58 percent higher than the height $H_1$ of the first end 52.

Figure 4:
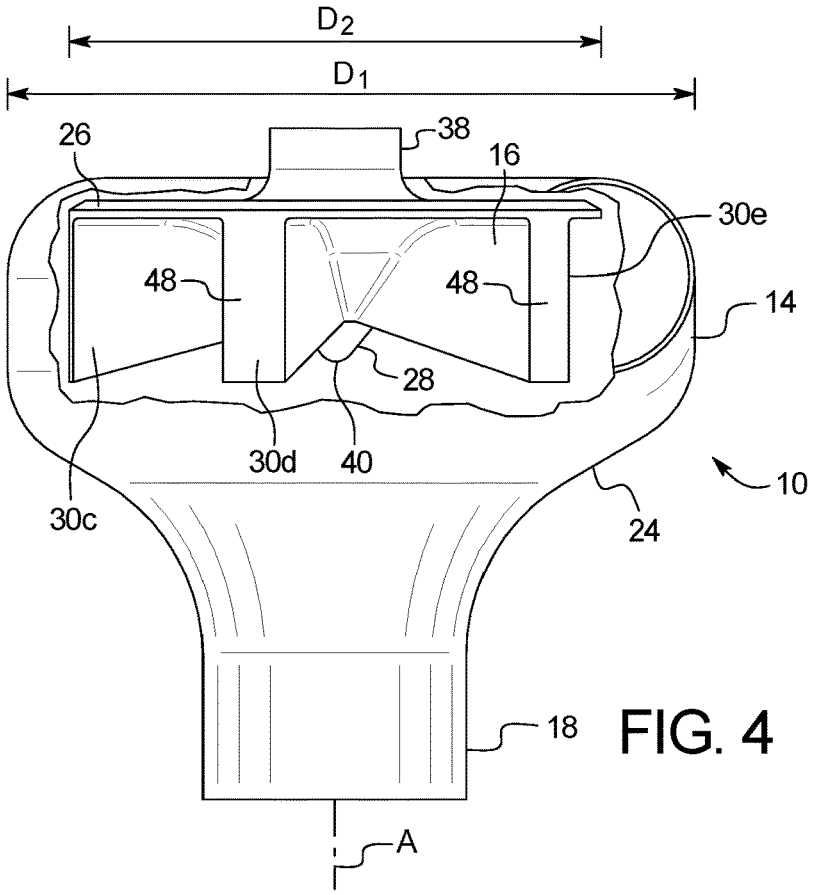
FIG. 4 is an elevational view in section of the pump of FIG. 1.
Figure 5:
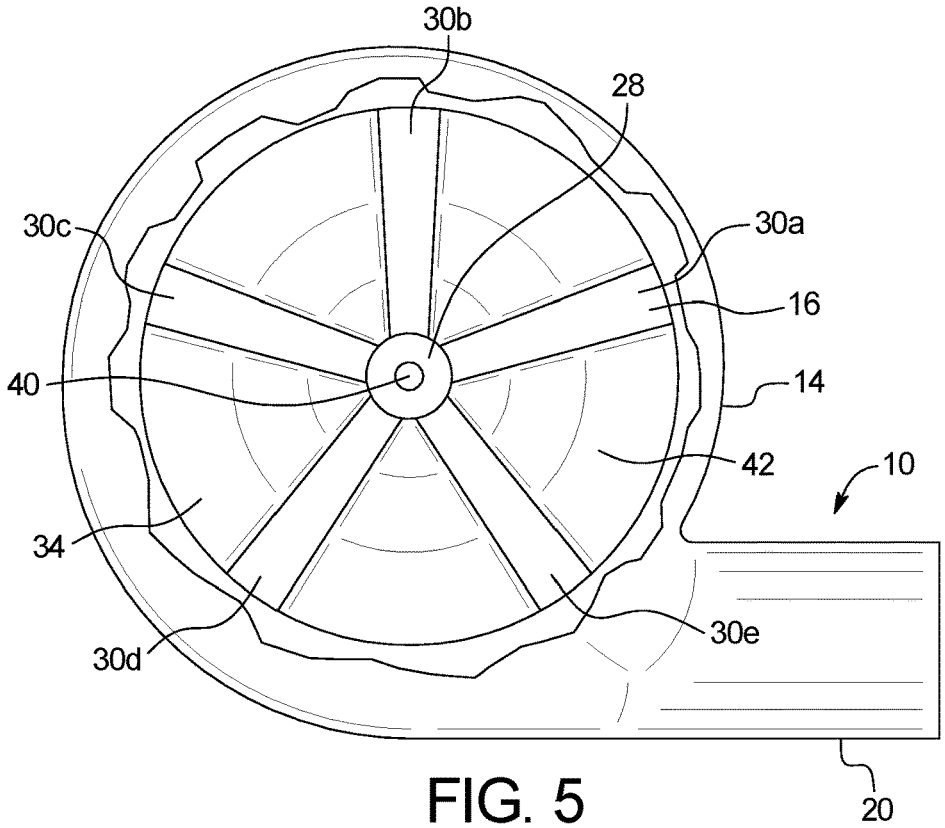
FIG. 5 is a bottom view in section of the pump of FIG. 1.
Figure 6:
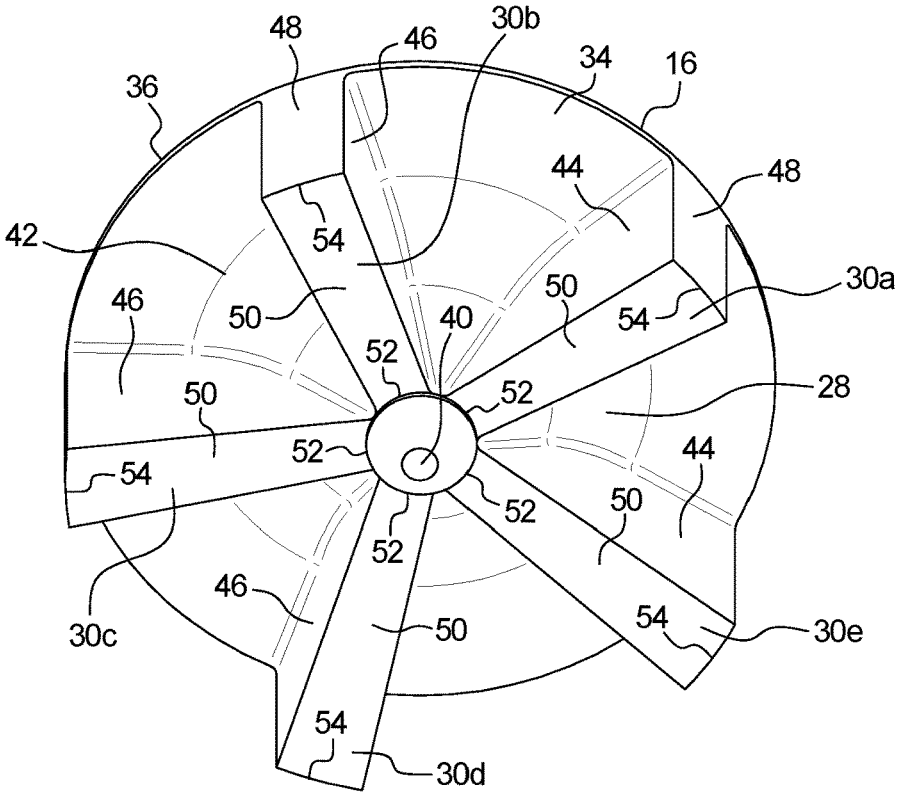
FIG. 6 is a bottom perspective view of the rotor for the pump of FIG. 1.
Figure 7:
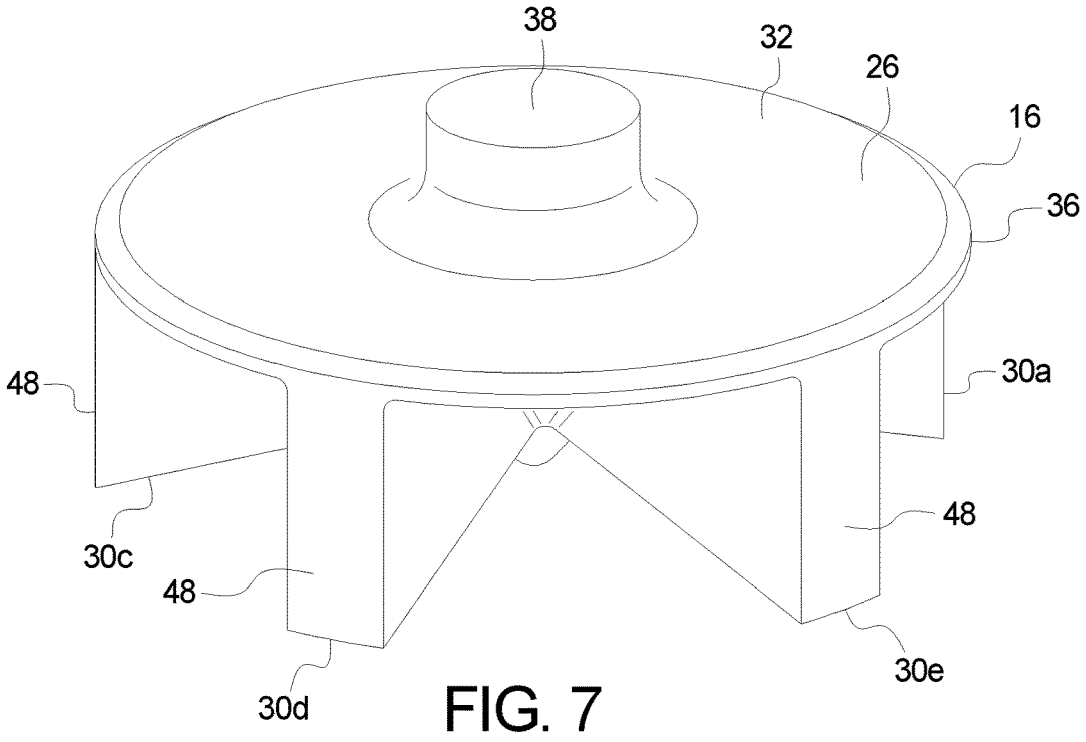
FIG. 7 is a top perspective view of the rotor of FIG. 6.

The outer surface 48 of the blades 30*a*-30*e* can be seen in at least FIGS. 3, 4, 6, 7, 9 and 11. The outer surface 48 is preferably a rectangular and is essentially parallel with the rotational or longitudinal axis A of the rotor 16. As shown specifically in FIGS. 9 and 11, the outer surface 48 forms a right angle (90 degrees) with the back plate 26. Moreover, as shown in FIG. 4, the outer surface 48 extends generally parallel with the inner surface 22 of the housing 14 and is spaced a prescribed distance therefrom (see e.g., FIG. 2). Such a configuration enables particles to be disposed between the outer surface 48 and the inner surface 22 of the housing 14.

Additionally, as shown in FIG. 11, the bottom surface 50 forms an angle $\beta$ of 75 degrees with the outer surface 48 and an angle $\theta$ of about 15 degrees with a line L parallel to the second side 34 of the back plate 26. This tapering results in the conical center portion 28 having a height $H_3$ from the second side 34 of the back plate 26 that is greater than the height $H_1$ of the first end 52 and less than the height $H_2$ of the second end 54. Thus in one embodiment, the conical center portion 28 has a height of about 4.27 inches. Thus, as can be understood, the height $H_3$ of the conical center portion 28 is about 83 percent of the height $H_2$ of the second end 54 and about 38 percent greater than the height $H_1$ of the first end 52. However, the height $H_3$ of the conical center portion 28 can be any suitable height.

Thus, as can be understood, the height of each of the blades 30*a*-30*e* increases from the conical center portion 28 of the rotor 16 towards the outside diameter or the circumferential edge 36 of the back plate 26, on the suction side of the rotor 16. This structure enhances the eddy currents for improved suction of fluid and creates clearance for larger particle sizes. The rotor 16 blade height at the outside diameter (i.e., at the circumferential edge 36) is kept close to the height of the outlet 20 or the diameter of the outlet 20 so as to be capable of pushing fluids directly into the outlet 20. This configuration reduces leakage, recirculation and pressure losses. The tapering blade height also helps reduce the torque, and thus reduce the power consumed versus a uniform blade height from the center to outer diameter. The outer blade height (i.e., $H_2$) can also be varied in proportion to the outlet 20 diameter of the housing 14, keeping the dimensions similar if desired.

As shown in FIG. 4, each of the blades 30*a*-30*e* is spaced a predetermined distance from the housing 14. Generally, the clearance between the blades 30*a*-30*e* and the housing 14 is kept at an additional 10-15% of the maximum particle size that is estimated to be in the material. This enables the rotor 16 to pass particles of significant size while reducing the wear of the blades 30*a*-30*e* in the rotor 16.

A rotor 16 having five blades is the preferable number of blades to reduce eddy current formation and recirculation between the rotor 16 blades. It has been found that too few blades can cause turbulence and may not enable higher flow rates to create the required pressure differential. Too many blades may reduce clearances prohibiting larger size particles from passing through the pump 10 and may reduce fluid volume allowable for ideal flow rate. However, the rotor 16 can have any suitable number of blades that will enable some flow with a suitable amount and size of particles to pass through the housing 14.

Embodiments described herein reduce Net Positive Suction Head (NPSH) because the embodiments can handle lower suction pressures and subsequent cavitation significantly better due to smoother streamlines relative the conventional systems. This improves the suction performance of the pump 10 and reduces the chances of cavitation and pump damage.

As can be understood, embodiments of the pumps described herein do not rely on the centrifugal principle of conventional pumps. Instead of a low tolerance impeller of a conventional pump, the pumps described herein use a specific geometric, recessed rotor to create a vortex of fluid or slurry like that of a tornado. That is, the Eddy Pump operates on the tornado principle. The tornado formed by the Eddy Pump and the rotor 16 generates a very strong, synchronized central column of flow from the pump rotor 16 to the pump inlet 18 and creates a low-pressure reverse eddy flow from the pump inlet 18 to the pump outlet 20. This action also results in an area of negative pressure near the pump seal. The negative pressure allows the pump 10 to achieve zero leakage.

Further the open rotor design described herein has high tolerances that enable any substance that enters the inlet 18 to be passed through the outlet 20 without issues. This translates to a significant amount of solids and debris that passes through the pump 10 without clogging the pump 10. In one embodiment, the pump 10 is capable of pumping up to 70% solids by weight and/or slurries with high viscosity and high specific gravity.

The configuration of the rotor 16 so as to be recessed also creates an eddy current that keeps abrasive material away from critical pump components. This structure improves pump life and reduces pump wear.

The tolerance between the rotor 16 and the housing 14 easily allows the passage of a large objects significantly greater than that of a centrifugal pump. For example, in a 2-inch to 10-inch Eddy Pump the tolerance ranges from 1-9 inches.

The embodiments described herein can have additional advantages, such as low maintenance, minimal downtime, low ownership costs and no need for steel high-pressure pipeline.

Since the Eddy Pump is based on the principle of Tornado Motion of liquid as a synchronized swirling column along the center of intake pipe that induces agitated mixing of solid particles with liquid, suction strong enough for solid particles to travel upwards into the housing or volute 14 and generating pressure differential for desired discharge is created. This eddy current is formed by the pressure differential caused by the rotor 16 and strengthened by turbulent flow patterns in the housing or volute 14 and suction tube. Eddy currents are strengthened by the presence of solid particles which increase the inertial forces in the fluid. The formation of the eddy depends on the suspended solid particles that causes suction. Unlike conventional vortex pumps, the rotor 16 directly drives the fluid through the pump with no slip. The Eddy Pump uses the movement of particles and the wake induced from these solid particles to generate Eddy Current and induce suction. Hence, efficiency is 7-10% better than conventional vortex pumps, with respect to horsepower. The eddy current generated by the Eddy Pump ensures steady movement of the mixture that leads to excellent non-clumping capabilities and the power to pump a very high concentration of solids, up to 70% by weight, and highly viscous fluids.

The drive motor 12 is conventional component that is well known in the art. Since drive motor 12 is well known in the art, this structure will not be discussed or illustrated in detail herein. Rather, it will be apparent to those skilled in the art from this disclosure that the components can be any type of structure and that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "portion," or "element" when used in the singular can have the dual meaning of a single part or a plurality of parts. Also as used herein to describe the above embodiment(s), the following directional terms "rearward", "top", and "bottom", as well as any other similar directional terms refer to those directions of the Eddy Pump. Accordingly, these terms, as utilized to describe the present invention should be interpreted relative to the Eddy Pump.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A pump rotor comprising:

a hub having a rotational axis;

a back plate having a planar surface; and a plurality of blades extending from the hub and disposed on the back plate, each of the plurality of blades having an outer surface essentially parallel to the rotational axis of the hub and a bottom surface opposite the back plate, and a first end adjacent the hub and a second end distal from the hub, the first end having a height from the planar surface that is less than a height from the planar surface of the second end, the bottom surface extending between the first end adjacent the hub and the second end distal from the hub and being planar, the plurality of blades configured to cause a synchronized central column of flow.

2. The pump rotor of claim 1, wherein the back plate extends an entire length of each of the plurality of blades.

3. The pump rotor of claim 1, wherein the plurality of blades defines a radial diameter, and the back plate has a diameter that is between 0.3 and 1.0 the radial diameter defined by the plurality of blades.

4. The pump rotor of claim 1, wherein the hub is conical.

5. The pump rotor of claim 4, wherein a conical vertex of the hub defines an angle of about 40 degrees.

6. The pump rotor of claim 1, wherein a central portion of the hub has a height from the planar surface that is greater than the height of the first end and less than the height of the second end.

7. The pump rotor of claim 1, wherein the first end has a first width and the second end has a second width, the first width being less than the second width.

8. The pump rotor of claim 1, wherein the outer surface is rectangular.

9. The pump rotor of claim 1, wherein the pump rotor is configured to be disposed in a housing and a bottom surface is configured to be spaced from an inner surface of the housing.

10. A pump rotor comprising:

a hub having a rotational axis;

a back plate having a planar surface; and a plurality of blades extending from the hub and disposed on the back plate, each of the plurality of blades having an outer surface essentially parallel to the rotational axis of the hub, and a first end adjacent the hub and a second end distal from the hub, the first end having a height from the planar surface that is less than a height from the planar surface of the second end, each of the plurality of blades including a bottom surface between the first end and the second end, and the bottom surface and the outer surface form an angle of about 75 degrees, and the plurality of blades configured to cause a synchronized central column of flow.

11. A pump, comprising:

a housing having an intake and a discharge; and a rotor including a hub, a back plate, and a plurality of blades extending from the hub and disposed on the back plate, each of the plurality of blades having an outer surface essentially parallel to a rotational axis of the hub and a bottom surface opposite the back plate, and a first end adjacent the hub and a second end distal from the hub, the first end having a height from a planar surface of the back plate that is less than a height from the planar surface of the second end, the bottom surface extending between the first end adjacent the hub and the second end distal from the hub and being planar the plurality of blades configured to cause a synchronized central column of flow.

12. The pump of claim 11, wherein the back plate is configured and arranged to prevent fluid leakage between the between the rotor and the housing.

13. The pump of claim 11, wherein the hub is conical and configured to enable laminar flow movement towards the discharge.

14. The pump of claim 13, wherein a conical vertex of the hub defines an angle of about 40 degrees.

15. The pump of claim 11, wherein the height of the second end is substantially similar to a height of the discharge.

16. The pump of claim 11, wherein the plurality of blades defines a radial diameter, and the back plate has a diameter that is between 0.3 and 1.0 the radial diameter defined by the plurality of blades.

17. The pump of claim 11, wherein a central portion of the hub has a height from the planar surface that is greater than the height of the first end and less than the height of the second end.

18. The pump of claim 11, wherein the first end has a first width and the second end has a second width, the first width being less than the second width.

19. The pump of claim 11, wherein the outer surface is rectangular.

20. A pump, comprising:

a housing having an intake and a discharge; and a rotor including a hub, a back plate, and a plurality of blades extending from the hub and disposed on the back plate, each of the plurality of blades having an outer surface essentially parallel to a rotational axis of the hub, and a first end adjacent the hub and a second end distal from the hub, the first end having a height from a planar surface of the back plate that is less than a height from the planar surface of the second end, each of the plurality of blades including a bottom surface between the first end and the second end, and the bottom surface and the outer surface form an angle of about 75 degrees, and the plurality of blades configured to cause a synchronized central column of flow.

21. A pump rotor comprising:

a hub having a rotational axis;

a back plate having a planar surface; and a plurality of blades extending from the hub and disposed on the back plate, each of the plurality of blades having an outer surface essentially parallel to the rotational axis of the hub, a first side surface and a second side surface, and a first end adjacent the hub and a second end distal from the hub, the first end having a height from the planar surface that is less than a height from the planar surface of the second end, the first and second side surfaces extending between the first end adjacent the hub and the second end distal from the hub and being planar, the plurality of blades configured to cause a synchronized central column of flow.

* * * * *